US005732640A

United States Patent [19]

Mizusaki et al.

[11] Patent Number: 5,732,640

[45] Date of Patent: Mar. 31, 1998

[54] LOOPER THREAD TAKE-UP APPARATUS

[75] Inventors: Takashi Mizusaki; Ichiro Nishiwaki; Masato Okabe, all of Toyonaka, Japan

[73] Assignee: Yamato Mishin Seizo Kabushiki Kaisha, Osaka, Japan

[21] Appl. No.: 912,981

[22] Filed: Aug. 12, 1997

Related U.S. Application Data

[63] Continuation of Ser. No. 705,681, Aug. 29, 1996, abandoned.

[30] Foreign Application Priority Data

Sep. 1, 1995 [JP] Japan ..... 7-225348

[51] Int. Cl.[6] ..... D05B 49/04

[52] U.S. Cl. ..... 112/248

[58] Field of Search ..... 112/241, 199, 112/248, 255, 200

[56] References Cited

U.S. PATENT DOCUMENTS

| | | | |
|---|---|---|---|
| 1,277,250 | 8/1918 | Onderdonk | 112/241 |
| 1,508,703 | 9/1924 | Leathem | 112/241 |
| 1,559,568 | 11/1925 | Gatchell | 112/248 |
| 1,723,195 | 8/1929 | Moffatt | 112/248 |
| 1,864,407 | 6/1932 | Christensen et al. | 112/248 |
| 2,350,725 | 6/1944 | Clayton | 112/248 |
| 2,350,726 | 6/1944 | Clayton | 112/248 |
| 2,866,427 | 12/1958 | Irmscher | 112/248 X |
| 5,487,347 | 1/1996 | Kogawara | 112/242 |

FOREIGN PATENT DOCUMENTS

| | | |
|---|---|---|
| 57-147677 | 9/1982 | Japan . |
| 6-154456 | 6/1994 | Japan . |
| 247919 | 5/1995 | Taiwan . |

*Primary Examiner*—Ismael Izaguirre

*Attorney, Agent, or Firm*—Burns, Doane, Swecker & Mathis, LLP

[57] ABSTRACT

A looper thread take-up apparatus which is mounted on a position away from a sewing machine bed, on the side facing a needle drop point of a leg portion for supporting the base end of a sewing machine arm on the machine bed with a thread take-up cam fixed on a rotating shaft which is projected from the side face of the leg portion and is interlocked with a sewing machine main shaft within the machine bed or with the upper shaft within the machine arm, where the looper thread take-up cam is rotated synchronously with the vertical motion of the needle at the nose of the machine arm, and with the advancing and retreating operations of a looper within the machine bed, thereby to make supplementary operations easier such as setting of the looper thread, adjusting of the loosening extent or the like without interference with the sewing operation.

6 Claims, 4 Drawing Sheets

LOOPER THREAD TAKE-UP APPARATUS

This application is a continuation of application Ser. No. 08/705,681 filed Aug. 29, 1996, now abandoned.

BACKGROUND OF THE INVENTION

1. Field of the Invention

The present invention relates to a looper thread take-up apparatus for loosening at a given timing the looper thread to be supplied to the looper arranged within a machine bed, 2. Description of the Related Art An interlock chainstitch sewing machine and a double chainstitch sewing machine are respectively provided with a needle in the tip end portion of the machine arm supported on a machine bed, and also, a looper within the machine bed and at a position corresponding to the drop point of the needle. The interlock chainstitch sewing machine and a double chainstitch machine respectively effect a sewing operation with a needle thread retained by the needle, and a looper thread retained in the looper through the synchronized operation of the needle and the looper by the transmission from the machine main shaft.

The needle effects its vertical operation of a given stroke reaching to the interior of the machine bed during its lowering movement. The looper effects the advancing and retreating operations (leftward advancing and rightward retreating) of a given stroke including a needle drop point halfway in a direction crossing the feeding direction of a sewing material on the machine bed. In the sewing, the operations are repeated in the following order of catching by the leftward advancing of the looper the loop of the needle thread remaining at the tip end of the needle when turning from the lowering movement to the rising movement of the needle and of catching by the lowering movement of the needle the loop of the looper thread remaining at the tip end of the looper when turning from the leftward advancing to the rightward retreating of the looper. Each loop of the mutually caught needle thread and the looper thread is tightened by the operation of the tension given respectively to form a seam.

The feeling of the seam to be formed as described above changes by the adjustment of the tightening extent through the increase or the decrease in the tension given to the needle thread and the looper thread. When the applied tension has been reduced excessively to obtain the seams of better feeling with a soft material or a thin material being an object for sewing, an obstacle is caused in obtaining the looper thread by the needle or the needle thread by the looper, which results in defectiveness in sewing such as stitch skipping. Conventionally this type of machine was provided with a looper thread take-up apparatus for straining and loosening the looper thread at a given timing.

The apparatus has a thread take-up cam of a circular flat plate with convexities and concavities continuously on the peripheral edge arranged in such a manner that a part of the peripheral edge projects from the surface of the frame of the thread take-up cam. The thread take-up cam is rotated and driven around the axis by the transmission from the machine main shaft which is a driving shaft of the needle and the looper. Also, thread eyelets are provided, respectively facing both sides of the thread take-up cam, on the surface of the frame. The looper thread passed through the mechanism for applying the tension is inserted into one of the thread eyelets, and inserted into the other, after being put across the peripheral edge of the thread take-up cam projected from the surface of the frame, and is guided to the looper.

The looper thread set as above is taken out when the convexity of the peripheral edge passing by the rotation of the thread take-up cam so that the took-out portion is loosened when the concavity continuous to the convexity passing. The loosening operation is effected in approximately synchronous relation with the looper operation, concretely the leftward advancing of the looper, so that the required supply of the looper thread is properly carried out for each seam. The looper thread is securely caught by the needle, because the looper thread keeps the given tension at the rightward retreating of the looper. Even when the soft material or the thin material is used as a sewing object, the seams of better feeling can be formed without defectiveness in sewing.

The loosening extent of the looper thread can be adjusted by a change in the respective mounting positions of the thread handling areas on both the sides of the thread take-up cam. The proper seams can be formed with respect to the various sewing materials by carrying out the position change with the adjustment of the applying tension according to the type of the sewing materials.

The looper thread take-up apparatus for effecting the above described operations was generally arranged within the machine bed so that the sewing operation on the machine bed might not be interfered with. The adjustment of the loosening extent of the looper thread was adapted to be carried out on the top face or the side face of the machine bed with a cover plate being open. But such construction as described above, has a problem that the various operations such as setting of the looper thread, adjusting of loosening extent or the like as described above are difficult.

To solve the problems, in Japanese Utility Model Application Laid-Open No. 57-147677 or Japanese Patent Application Laid-Open No. 6-154456 is disclosed a machine provided with a looper thread take-up apparatus arranged on the external side of the front face (which faces the sewing operator) of the machine bed. In the former, the thread take-up cam is mounted on a rotating shaft, provided substantially parallel to the extending direction of the machine bed, and interlocked with and coupled to the projecting end of the machine main shaft to one end side of the machine bed by a transmission belt. In the latter, the thread take-up cam is mounted on the rotating shaft projecting to a direction substantially orthogonal to it on the front face of the machine bed. The rotation of the machine main shaft within the machine bed is transmitted to the rotating shaft and the thread take-up cam is rotated in accordance with the rotation of the machine main shaft.

But in the above-described construction, the existence of the looper thread take-up apparatus on the front face of the machine bed becomes an obstacle to the feeding operation of a sewing material onto the machine bed, especially with possibility of the sewing material in twining around the thread take-up cam which rotates at all times. When a cover was provided to cover the front face of the looper thread take-up apparatus to dissolve the inconveniences, the front face of the machine is uselessly projects to cause deteriorations in the operation and in the appearance. At the same time, the mounting operation of the various supplementary apparatuses necessary for sewing operation was restricted and therefore spare special parts were required for mounting purpose.

SUMMARY OF THE INVENTION

Accordingly, an object of the present invention is to provide an improved looper thread take-up apparatus which is capable of easier securing of arranging positions, of easily carrying out supplementary operations such as setting of the looper thread, adjusting of the loosening extent or the like without interference with the sewing operation, and the mounting of accompanying apparatuses necessary for the sewing operation.

In the looper thread take-up apparatus in accordance with the present invention, a rotating shaft is projected away from the top face of the machine bed on a face confronting the needle drop point of the leg portion erected on the machine bed to support the base end of the machine arm, the rotating shaft is interlocked with and coupled to inside the leg portion directly the machine main shaft (lower shaft) within the machine bed or indirectly through the upper shaft within the machine arm to rotate in accordance with the rotation of the machine main shaft. A thread take-up cam is provided in a projection end of the rotating shaft, namely, a portion, where the feeding operation of the sewing material on the machine bed is not hindered due to no projection to the front side of the machine, with providing the frame and the thread handling area.

DETAILED DESCRIPTION OF THE PREFERRED EMBODIMENTS

Figure 1:
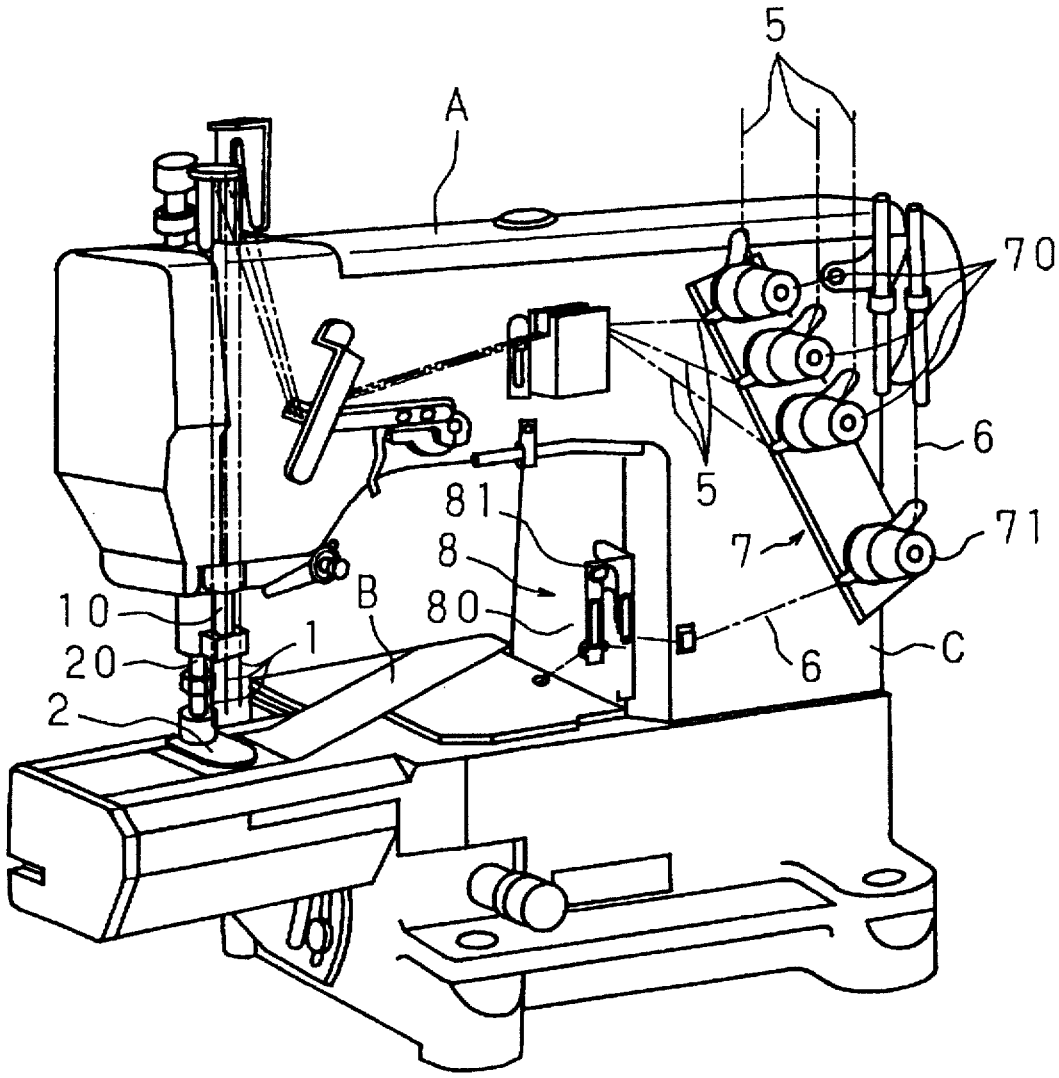
FIG. 1 is a perspective view showing the appearance of an interlock chainstitch sewing machine provided with a looper thread take-up apparatus of the present invention.
Figure 2:
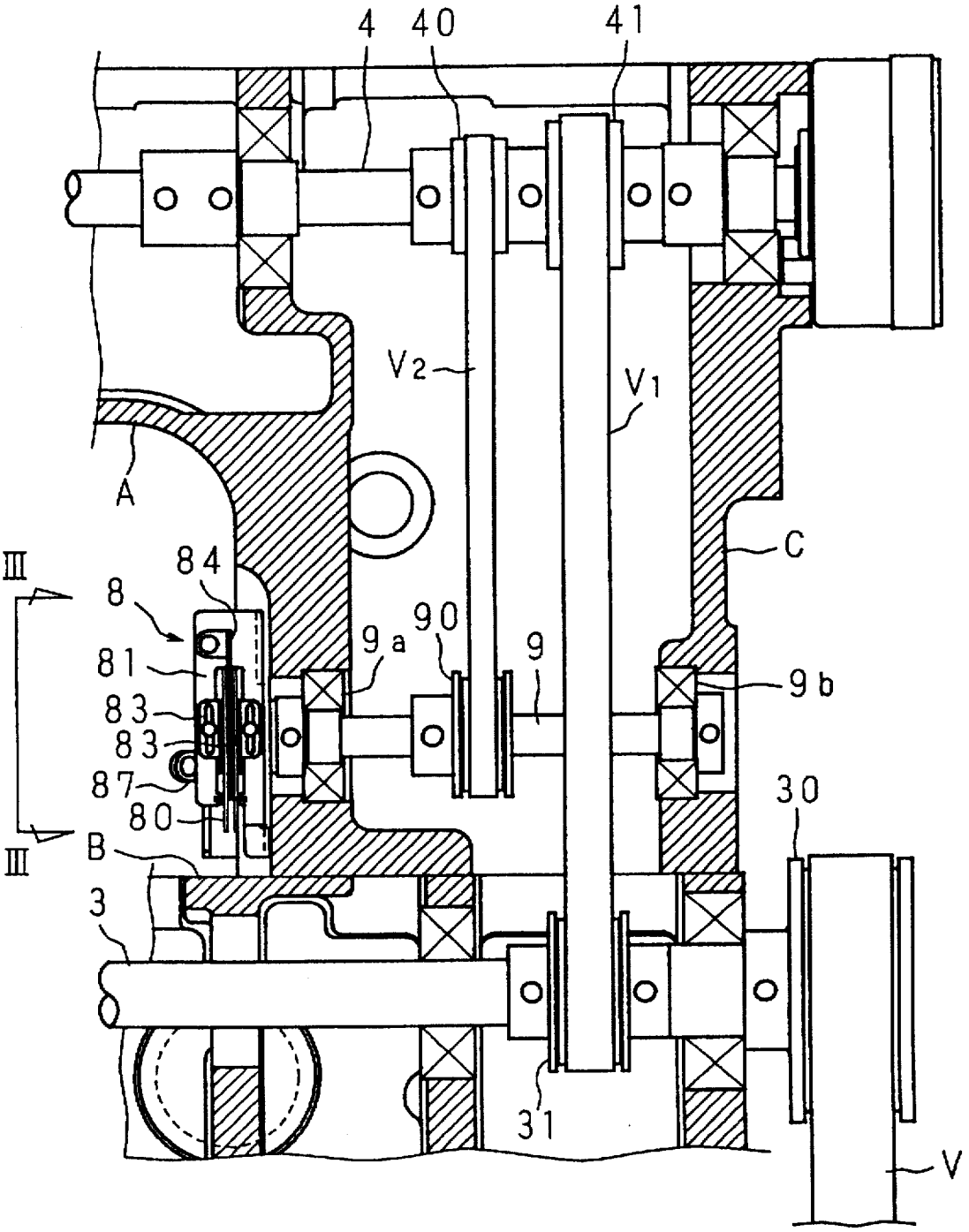
FIG. 2 is a front sectional view of the essential portions of the interlock chainstitch sewing machine provided with the looper thread manipulation apparatus of the present invention.

The present invention will be described in detail thereafter in accordance with the embodiment. FIG. 1 is a perspective view showing an outer appearance of an interlock chainstitch sewing machine provided with a looper thread take-up apparatus in accordance with the present invention. FIG. 2 is a front sectional view of the essential portions likewise.

The machine provided with the apparatus of the present invention is provided with a machine arm A extended substantially in parallel in a position properly spaced from the top face of a machine bed B with the base end thereof being supported by a leg portion C erected on the machine bed B. The nose of the machine arm A has a needle bar 10 and a presser bar 20 supported so as to pierce the arm A vertically. To the lower end of the needle bar 10 are attached plural needles 1, 1 and to the lower end of the presser bar 20 is attached a presser foot 2. A looper not shown is arranged inside on the tip end side of the machine bed B facing the tips of the needles 1, 1.

As shown in FIG. 2, the inside of the machine arm A, the machine bed B and the leg portion C is hollow. A machine main shaft (lower shaft) 3 is supported rotatably around the axis along its longitudinal direction within the machine bed B, while an upper shaft 4 is supported within the machine arm A around the axis along its longitudinal direction. The machine main shaft 3 which projects to a proper length from one side of the machine bed B, is coupled to the output end of the machine motor not shown through a transmission belt V wound around a pulley 30 engaged with the projection end. The machine main shaft 3 and the upper shaft 4 are coupled to each other, inside the leg portion C, by a timing belt $V_1$ wound around belt pulleys 31 and 41, same in diameter, fitted to the respective corresponding positions.

The machine main shaft 3 and the upper shaft 4 are adapted to rotate synchronously around the shaft by the transmitted power from the machine motor. The needles 1, 1 . . . at the nose of the machine arm A move vertically by the given stroke in accordance with the vertical movements of the needle bar 10 which moves according to the rotation of the upper shaft 4. The looper within the machine bed B is adapted to effect a given operation synchronous with the vertical operation of the needles 1, 1 . . . in accordance with the rotation of the machine main shaft 3.

The vertical strokes of the needles 1, 1 are set to reach the interior of the machine bed B when lowering. Also, the looper advances and retreats (leftward advancing and rightward retreating) of the given stroke including the lowering position (needle drop point) of the needles 1, 1 . . . halfway in the longitudinal direction (from right to left direction in FIG. 2) of the machine bed B.

The sewing material not shown is fed to the needle drop position on the machine bed B in a direction substantially orthogonal respectively to the moving directions of the needles 1, 1 . . . and the looper. The material is grasped between the top face of the machine bed B and the presser foot 2 to be fed in a given way. The sewing material is sewn stitch by stitch by motions repeated in the following order; the looper catches in the leftward advance loops of needle threads 5, 5 . . . left at the tips of the needles 1, 1 when turning to rise, which penetrated the sewing material in lowering to reach the inside of the machine bed B; the needles 1, 1 catch by the lowering the loop of the looper thread 6 remained at the tip of the looper when turning from the leftward advance to the rightward retreat.

A thread tension mechanism 7, for adjusting the tensions to be given to the needle threads 5, 5 . . . and the looper thread 6, is arranged on the front face of the leg portion C for supporting the base end of the machine arm A. Also, a looper thread take-up apparatus 8 of the present invention is arranged, in a position away from the top face of the machine bed B, on one face (left side face) of the leg portion C facing the needle drop point.

The thread tension mechanism 7 has a plurality of needle thread tension knobs 70, 70 . . . corresponding respectively to the needles 1, 1 . . . . and one looper thread tension knob 71 on the long support attached to the face of the leg portion C, and has known construction for increasing and decreasing the pressure between the respective one pair of elastically contacted tension discs provided on the respective base portions by the rotating operations. The needle threads 5, 5 . . . are respectively inserted between the tension discs at the base portions of the needle thread tension knobs 70, 70 . . . , and thereafter are guided to the upper end of the needle bar 10 through the given thread handling area prepared along the front face of the machine arm A. Further, the needle threads 5, 5 . . . are guided downwards along the front side of the needle bar 10 so that the threads are set in a condition where they are respectively inserted through into an eye at the tip end of each needle 1. The set state is shown roughly by one dot chain line in FIG. 1.

The needle threads 5, 5 . . . set in this way are pulled out against the grasping pressure between the tension discs of the needle thread tension knobs 70, 70 . . . in the thread tension mechanism 7 by the downward motion of the needles 1, 1 . . . . At this time a constant tension corresponding to the contact extent of the tension discs is given to the needle threads 5, 5 . . . remained at the previous upward motion at this time, thereby to strain stitches formed by those needle threads 5, 5 . . . on the sewing material.

The looper thread 6 is inserted between the tension discs at the base portion of the looper thread tension knob 71 of the thread tension mechanism 7 as the needle threads 5, 5 . . . , and thereafter is guided into the interior of the machine bed B through the looper thread take-up apparatus 8 to be set to the looper arranged in the tip end portion of the machine bed B. The looper thread take-up apparatus 8 strains and loosens the looper thread 6 at a given timing as in conventional this type of machine, and is provided with a thread take-up cam 80 rotating together with rotation of the machine main shaft 3, and a support 81 of the cam 80.

Figure 3:
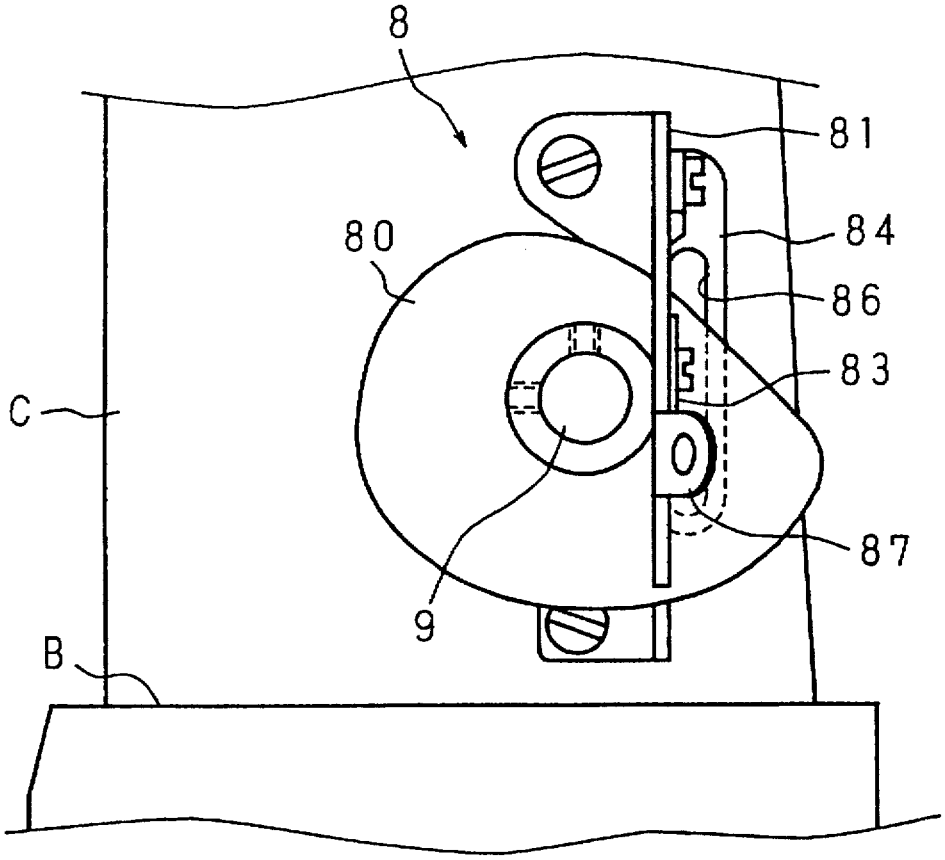
FIG. 3 is view taken in the direction of the arrows along a line of III—III of FIG. 2 showing the enlarged mounting portion of the looper thread take-up apparatus of the present invention.
Figure 4:
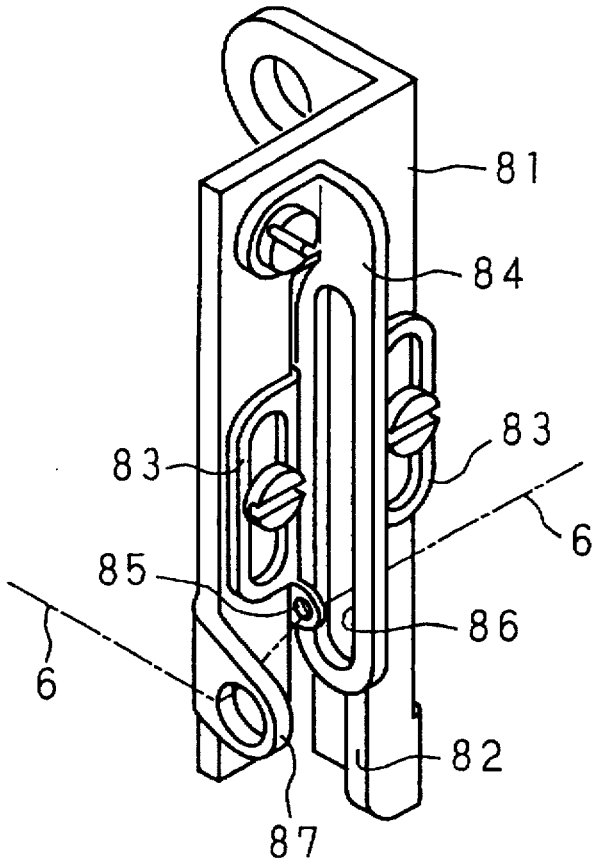
FIG. 4 is a perspective view showing the construction of the frame of the looper thread take-up apparatus.

FIG. 3 is a view taken in the direction of the arrows along a line of III—III of FIG. 2 showing the enlarged mounting portion of the looper thread take-up apparatus 8. FIG. 4 is a perspective view showing the construction of the support 81. As shown in FIG. 4, the support 81 is a rectangular flat plate provided with a groove 82 of a prescribed width along the longitudinal direction in the approximately middle of the width direction. The support 81 has a pair of mounting seats, where both the end portions of one edge in the width direction are bent at approximately right angle, attached to the left face of the leg portion C, and is mounted with the surface being alongside of the front face of the leg portion C, as shown in FIG. 2 and FIG. 3.

A pair of thread guides 83, 83 are fixed along both the side edges of the groove 82 by tightening of the respective fixing screws which are screwed into respective tapped holes formed on the surface. Also, a guide plate 84 is fixed by the tightening of a screw screwed into a tapped hole formed on the surface so that it extends along the longitudinally direction approximately in the middle of the groove 82. The fixing positions of the guides 83, 83 are movable along the side edge of the groove 82 within the length range of the long insertion hole of each fixing screw. One longitudinal end portion of each of the thread guides 83, 83 is bent orthogonally to the surface of the support 81 and slightly projected from the surface. A thread eyelet 85 is bored in the bent portion (shown only on the single side) for the insertion of the looper thread 6.

The guide plate 84 is fixed in the lateral side which hems one end portion of the groove 82. A main body portion of the guide plate 84 extending along the longitudinal direction in the approximately central portion of the groove 82 is provided with a long hole 86 with approximately full length in the width direction orthogonal to the surface of the support 81. The thread eyelets 85, 85 of the thread guides 83, 83 oppose each other across the long hole 86.

The thread take-up cam 80 has two cam plates superposed with a prescribed gap in the thickness direction as shown in FIG. 2. The cam plate has a plane shape where convexity and concavity are respectively formed, across a prescribed range, on the peripheral edge of the circular flat plate as shown in FIG. 3. The thread take-up cam 80 is fixedly engaged with the tip end of a rotating shaft 9 projected from the left side face of the leg portion C to rotate counterclockwise in FIG. 3 within the plane parallel to the left side face.

As shown in FIG. 2, the rotation shaft 9 has the intermediate portion supported on the left side wall of the leg portion C and the other end portion on the right side wall by different bearings 9*a*, 9*b* so that it is supported to cross the inner hollow of the leg portion C. A belt pulley 90 is engaged with the approximately middle portion of the support positions by the bearings 9*a*, 9*b*. A belt pulley 40 is engaged correspondingly to the belt pulley 90 and on one side of the belt pulley 41 which is provided for coupling to the machine main shaft 3, with the upper shaft 4 supported within the machine arm A. The rotating shaft 9 is coupled to the upper shaft 4 by the timing belt $V_2$ wound around the belt pulleys 40, 90, having equal diameters.

The rotating shaft 9 is rotated synchronously with both the machine main shaft 3 and the upper shaft 4 by the power conducted from the machine motor. The thread take-up cam 80 fixed to the tip end of the rotating shaft 9 rotates synchronously with the vertical motions of the needle 1, 1 . . . at the nose portion of the machine arm A or the advancing and retreating operation of the looper within the machine bed B.

As shown in FIG. 3, the thread take-up cam 80 is positioned with the guide plate 84 being inserted into the gap of two cam plates which constitute the cam 80 and with one portion of the peripheral edge projecting through the groove 82 from the surface of the support 81. The looper thread 6 passed through the thread tension mechanism 7 is set to be inserted into the thread eyelet 85 of the one thread guide 83 on the side closer to the thread tension mechanism 7, and inserted into the thread eyelet 85 of the other thread guide 83 through the long hole 86 formed in the guide plate 84 so that it may be guided into the machine bed B through a thread take-up portion 87 formed by raising one portion of the side edge of the support 81 on the same side of the other thread guide 83. The inserting condition of the looper thread 6 on the support 81 is shown with one dot chain line in FIG. 4, and a condition of the whole looper thread 6 is roughly shown by one dot chain line in FIG. 1.

The looper thread 6 set in this way is layed across the peripheral edges of two cam plates of the thread take-up cam 80 projecting from the surface of the support 81 between the guide plate 84 and thread guides 83, 83 on both the sides. The thread take-up cam 80 is a circular flat plate having convexity and concavity described hereinabove on the peripheral edge. When the thread take-up cam 80 is rotated, the looper thread 6 layed across the peripheral edges is strained by the raising in passing the convexity, and is loosened by releasing from the raising in passing the concavity continuous to the convexity.

The looper thread 6 is taken out against the grasping pressure between the thread grasping plates of the looper thread tension knob 71 in the thread tension mechanism 7 by the leftward advance of the looper as in the needle threads 5, 5 . . . . Then the tension is given to the looper thread 6 remained at the previous rightward retreating operation so that the seam formed on the sewing material is tightened by the looper thread 6. The looper thread take-up apparatus 8 is interposed in the route of the looper thread 6 from the thread tension mechanism 7 to the looper. The looper thread 6 is loosened on the exit side of the thread tension mechanism 7 by the rotation of the thread take-up cam 80.

The loosening timing is made to approximately agree with the leftward advance timing of the looper by the adjustment of the mounting angle of the thread take-up cam 80 to the rotating shaft 9. The tightening of the looper thread 6 is effected at a timing approximately same as the loosing by the looper thread take-up apparatus 8 so as to reduce the tightening degree. Thus, the seams with desirable feeling for the soft sewing material and the thin sewing material, with the looper thread 6 being intertwined loosely with the needle thread 5, 5 . . . are formed.

The loosening extent of the looper thread by the operation of the looper thread take-up apparatus 8 is increased or decreased by the movement, in the longitudinal direction of the groove 82, of the fixing position of the thread guides 83, 83 on both the sides of the thread take-up cam 80, and by change in the crossing position of the looper thread 6 onto the peripheral edge of the thread take-up cam 80. Thus, proper seams can be formed in accordance with the type of sewing materials hard, soft, thick, thin or the like.

As described above, the looper thread take-up apparatus 8 is mounted on the left side face of the leg portion C which supports the machine arm A. Therefore, the position of the thread guides 83, 83 on the support 81 can be easily changed from the front side of the machine by once loosening the respective fixing screws and moving the guides 83, 83 properly along the surface of the support 81 alongside of the front face of the leg portion C, and tightening the screws. The setting operation of the looper thread 6, as described above can be effected from the front side of the machine, likewise.

Also, the mounting position of the looper thread take-up apparatus 8 is away from the needle drop point where the sewing is performed, and also away from the top face of the machine bed B which is a feeding face of the sewing material. Accordingly, there is no possibility of the looper thread take-up apparatus 8 interfering with the operator in feeding the sewing material such as twining of the sewing material around the thread take-up cam 80 rotating at all times during the sewing operation.

In the above described embodiment, the rotating shaft 9 of the thread take-up cam 80 is interlocked with the upper shaft 4 within the machine arm A by the timing belt $V_2$ layed between the belt pulleys 90, 40, but the rotating shaft 9 of the thread take-up cam 80 may be interlocked directly with the machine main shaft 3 within the machine bed B. Furthermore, transmitting means such as gear apparatus or the like other than the timing belt $V_2$ can be used between the rotating shaft 9 and the machine main shaft 3 or the upper shaft 4.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A looper thread take-up apparatus attached to a sewing machine with a needle being provided at the nose of a machine arm supported on a machine bed, and with a looper being provided at the position within the machine bed corresponding to the needle drop point, where a sewing operation is performed by moving the needle and the looper synchronously with the rotation of the machine main shaft, which loosens a looper thread fed to the looper in the prescribed operation timing of said looper by the rotation of a thread take-up cam corresponding to the rotation of a main shaft of the sewing machine, said apparatus being characterized in that said thread take-up cam is attached to a rotating shaft projected from a leg portion of the sewing machine for supporting the base end of the machine arm on the machine bed on the side facing said needle drop point, and interlocked with said machine main shaft within said leg portion.

2. A sewing machine provided with a looper thread take-up apparatus of claim 1.

3. A looper thread take-up apparatus as set forth in claim 1, wherein said rotating shaft and machine main shaft are interlocked with each other by a timing belt layed between the rotation shaft and the machine main shaft.

4. A sewing machine provided with a looper thread take-up apparatus of claim 3.

5. A looper thread take-up apparatus as set forth in claim 1, wherein a support equipped with a thread guide member for guiding said looper thread to the thread take-up cam is provided on one face of said leg portion, with the attaching side of said thread guiding member directing frontward.

6. A sewing machine provided with a looper thread take-up apparatus of claim 5.

* * * * *